United States Patent [19]

Fish

[11] 4,185,350

[45] Jan. 29, 1980

[54] SCARIFYING ATTACHMENT FOR FLOOR MACHINE

[75] Inventor: Ronald W. Fish, Roselle, Ill.

[73] Assignee: Trico Equipment Corporation, Chicago, Ill.

[21] Appl. No.: 929,709

[22] Filed: Jul. 31, 1978

[51] Int. Cl.[2] ..... A47L 13/02

[52] U.S. Cl. ..... 15/236 C; 15/93 R; 29/81 J

[58] Field of Search ..... 15/93 R, 236 R, 236 NO, 15/236 C; 125/5; 29/81 J

[56] References Cited

U.S. PATENT DOCUMENTS

| | | | |
|---|---|---|---|
| 1,756,734 | 4/1930 | Emminger | 125/5 |
| 2,235,446 | 3/1941 | Birger et al. | 29/81 J |
| 3,309,729 | 3/1967 | Dresser | 15/236 NO |
| 3,351,046 | 11/1967 | Collins | 15/236 NO X |
| 3,365,772 | 1/1968 | Collins | 15/93 R X |
| 3,678,532 | 7/1972 | Boyd | 15/236 NO |
| 3,731,338 | 5/1973 | Walsh et al. | 15/236 R |

*Primary Examiner*—Edward L. Roberts

*Attorney, Agent, or Firm*—Vogel, Dithmar, Stotland, Stratman & Levy

[57] ABSTRACT

Scarifying or abrading apparatus is designed for attachment to a hand-operated single-shaft rotary floor maintenance machine, the apparatus including a circular attachment plate having a plurality of pairs of radially spaced-apart rectangular holding members, there being rotatably mounted between the members of each pair of members a plurality of cutters disposed for rotational scarifying engagement with the floor when the disc is rotated by the machine.

9 Claims, 5 Drawing Figures

FIG. 1
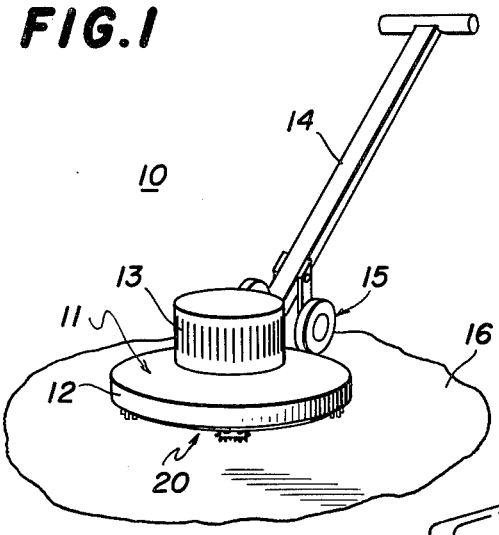
FIG. 2
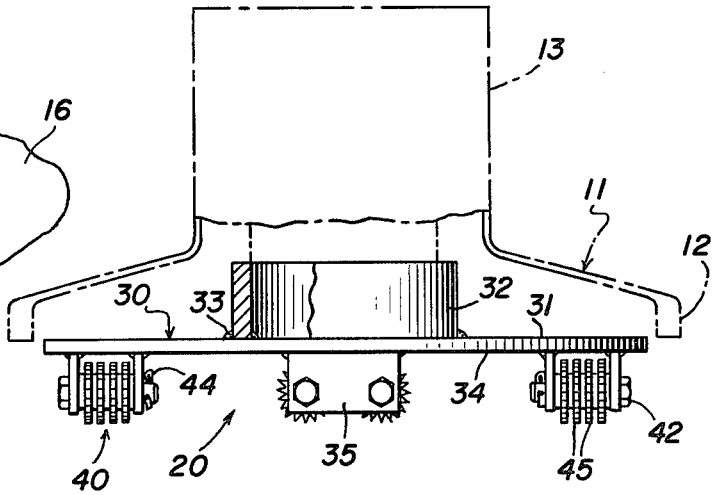
FIG. 3
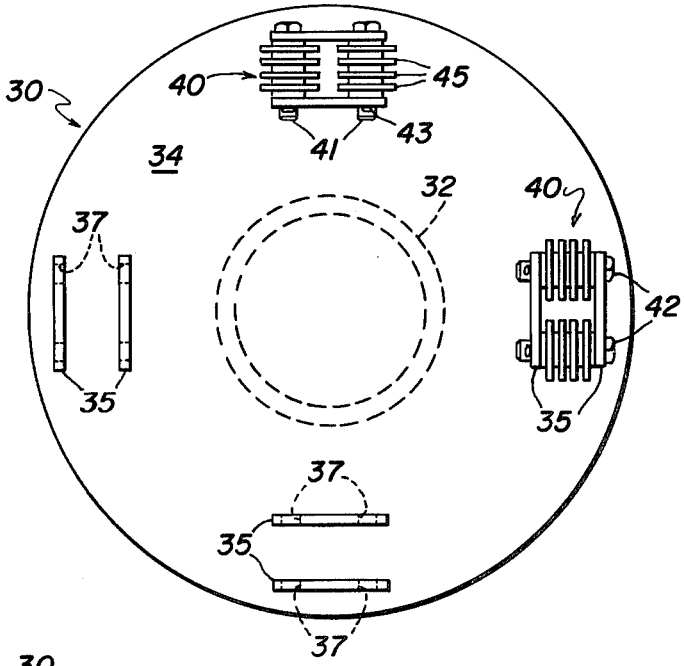
FIG. 4
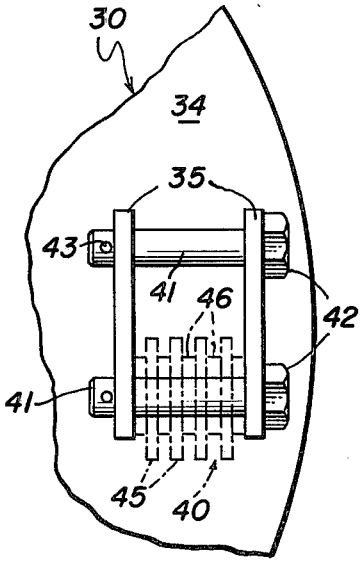
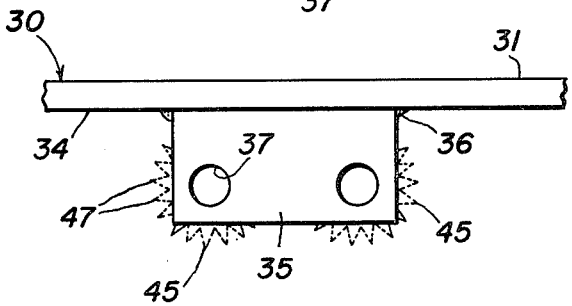
FIG. 5

SCARIFYING ATTACHMENT FOR FLOOR MACHINE

BACKGROUND OF THE INVENTION

The present invention relates to abrading or scarifying tools for floor maintenance machines, particularly tools for cleaning floors having heavy dirt, oil, paint or the like built up thereon which cannot easily be removed by simple sweeping or scrubbing operations.

Abrading or scarifying machines for removing caked-on grime or other material from floors are known in the art, but such machines are typically large, self-propelled industrial machines, which are too large and expensive for use by small concerns or individuals. Typical of such machines is one sold by the Tennant Company (Model K-4). Such machines are typically used for cleaning large areas such as factory floors, airport runways and the like.

For smaller cleaning jobs, hand-operated machines are normally used, these machines typically having one or more rotating discs or brushes, and being maneuvered by hand across the floor by an operator. Such a machine is illustrated in the U.S. Pat. No. 3,678,532 issued to R. L. Boyd on July 25, 1972. Probably the most commonly used of such machines are the single-shaft type, but heretofore there has not been provided for such machines a suitable abrading or scarifying attachment. Boyd discloses scraping apparatus for such a machine, but it is of fairly complex construction and is arranged with cutters mounted outboard of a rotating disc so that the scraped material will be thrown up above the disc and can foul the attachment thereof with the motor shaft.

Other rotating scraping or abrading tools are known in the art and are disclosed, for example, in U.S. Pat. No. 3,309,729, issued to J. G. Dresser on Mar. 21, 1967, No. 3,351,046, issued to R. C. Collins on Nov. 7, 1967, No. 3,708,880, issued to J. H. Norfleet on Jan. 9, 1973, and No. 3,731,338, issued to Walsh et al. on May 8, 1973. But all of these latter devices are for attachment to hand-held power tools and are not adapted for use with a floor maintenance machine.

SUMMARY OF THE INVENTION

The present invention relates to an abrading or scarifying apparatus uniquely designed for attachment to a single-shaft floor maintenance machine.

It is an important feature of the present invention that the scarifying attachment apparatus is of simple and economical construction and provides ready mounting and demounting on the associated machine, while preventing scraped or abraded material from entering into the vicinity of the motor housing.

Another feature of the invention is the provision of scarifying apparatus of the character described, wherein the cutters are removably mountable for ready replacement.

These and other features of the invention are attained by providing scarifying apparatus for attachment to a rotary floor maintenance machine having a single vertical shaft, the apparatus comprising a substantially flat circular disc, a cylindrical attachment collar connected to one side of the disc and extending therefrom coaxially therewith for coupling the disc to the shaft of the associated machine for rotation therewith, a plurality of pairs of spaced-apart holding members secured to the other side of the disc and extending therefrom, axle means extending between the holding members of each pair of holding members, and a plurality of cutting members rotatably mounted on each of the bearing means for rotational scarifying engagement with the associated floor as the disc is rotated by the associated machine, the holding members and the axle means and the cutting members being disposed entirely within the perimeter of the disc.

Further features of the invention pertain to the particular arrangement of the parts of the scarifying apparatus whereby the above-outlined and additional operating features thereof are attained.

The invention, both as to its organization and method of operation, together with further objects and advantages thereof, will best be understood by reference to the following specification taken in connection with the accompanying drawings.

BRIEF DESCRIPTION OF THE DRAWINGS

FIG. 1 is a perspective view of a single-shaft floor maintenance machine having mounted thereon the scarifying apparatus of the present invention;

FIG. 2 is an enlarged side elevational view of the scarifying apparatus of the present invention, shown in its mounted position in a floor maintenance machine;

FIG. 3 is a bottom plan view of the scarifying apparatus of FIG. 2;

FIG. 4 is an enlarged fragmentary bottom plan view of one of the cutter assemblies of the apparatus of FIG. 3; and FIG. 5 is a side elevational view of the cutter assembly of FIG. 4.

DESCRIPTION OF THE PREFERRED EMBODIMENT

In FIG. 1 of the drawings there is illustrated a standard single-shaft hand-operated floor maintenance machine, generally designated by the numeral 10, which includes a large circular housing 11 provided at the perimeter thereof with a downwardly extending cylindrical skirt 12. Disposed centrally of the housing 11 and extending upwardly therefrom coaxially therewith is a cylindrical motor housing 13 for accommodating an electric motor with a vertically disposed output shaft. Fixedly secured to the housing 11 is a handle 14, which also has secured thereto adjacent to the housing 11 a rear wheel assembly 15 for facilitating the movement of the machine 10 across the floor 16.

The present invention is an abrading or scarifying assembly, generally designated by the numeral 20, for attachment to the motor shaft of the machine 10 for use in place of the other polishing, buffing or scrubbing attachments typically used with the machine 10. The scarifying assembly 20 includes a large circular plate or disc, generally designated by the numeral 30, which has a diameter slightly less than the diameter of the cylindrical skirt 12 of the machine 10 and is receivable therein. Fixedly secured to the top surface 31 of the disc 30 as by weldments 33, and extending upwardly therefrom coaxially therewith is a cylindrical attachment collar 32 which may be provided at the upper end thereof with suitable means for attachment to the motor shaft of the machine 10 for rotation thereby. The bottom surface 34 of the disc 30 has fixedly secured thereto as by weldments 36 a plurality of pairs of holding blocks 35, these pairs being equiangularly spaced apart around the disc 30 and preferably four in number, although it will be understood that any other number of pairs of holding blocks 35 could be provided.

Each of the holding blocks 35 is a rectangular plate which lies in a plane normal to the plane of the disc bottom surface 34 and also normal to a radius of the disc 30, the holding blocks 35 of each pair thereof being spaced apart radially of the disc 30 a predetermined distance. Preferably, all of the holding blocks 35 are disposed within the perimeter of the disc 30 so that no portion thereof extends outwardly beyond the edge of the disc 30. Each of the holding blocks 35 has a pair of spaced-apart apertures 37 therethrough, the apertures 37 of each holding block 35 being respectively coaxial with the corresponding apertures in the other holding block 35 of that pair, these axes preferably being substantially normal to the holding blocks 35.

Mounted on each of the pairs of holding blocks 35 is a cutter assembly, generally designated by the numeral 40, which includes two axles 41, each in the form of a bolt having a head 42 at one end thereof and an aperture 43 extending diametrically therethrough adjacent to the other end thereof, with the bolt being received through one of the aligned sets of apertures in the holding blocks 35, and preferably being retained in place thereon by a cotter pin 44 extending through the aperture 43. Rotatably mounted on each of the axles 41 is a plurality of circular cutters 45 alternating with circular spacers 46, each of the cutters 45 having a plurality of teeth 47 around the perimeter thereof which extend radially outwardly beyond the spacers 46 and beyond the bottom edges of the holding blocks 35.

In use, it will be appreciated that as the disc 30 is rotated by the machine 10, the cutters 45 engage the underlying floor 16 or other surface and effect rotation of the cutters 45 about the axles 41. Whenever the cutters 45 become worn, or if it is desired to substitute a different type or size of cutter, the cutters 45 are readily removable by removing the cotter pins 44 and axles 41, replacement of the cutters 45 being thereby greatly facilitated. Preferably, the diameter of the disc 30 is only slightly less than the inner diameter of the cylindrical skirt 12 of the machine 10. This arrangement, together with the fact that the cutter assemblies 40 are all disposed within the perimeter of the disc 30 and entirely therebelow serves to inhibit the invasion of the space above the disc 30 by material which has been scraped or abraded from the floor 16.

In a constructional model of the scarifying apparatus of the present invention, the disc 30, attachment collar 32 and holding blocks 35 are preferably all formed of metal, as are the cutters 45, but it will be appreciated that other materials could be used.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. An attachment plate for mounting scarifying members on a rotary floor maintenance machine having a single vertical shaft, said plate comprising a substantially flat circular disc, a cylindrical attachment collar connected to one side of said disc and extending therefrom coaxially therewith for coupling said disc to the shaft of the associated machine for rotation therewith, a plurality of groups of holding members secured to the other side of said disc and spaced apart equiangularly therearound and disposed entirely within the perimeter thereof, the holding members of each group of holding members being spaced apart radially of said disc and having two sets of horizontally aligned coaxial apertures therethrough for rotatably supporting therebetween a plurality of associated scarifying members, the axes of the two sets of apertures being substantially parallel.

2. The attachment plate of claim 1, wherein said disc includes four groups of said holding members.

3. The attachment plate of claim 1, wherein each of said holding members comprises a flat rectangular plate lying in a plane disposed substantially normal to the plane of said disc and substantially normal to a radius thereof.

4. The attachment plate of claim 1, wherein each of said groups of holding members consists of two holding members.

5. Scarifying apparatus for attachment to a rotary floor maintenance machine having a single vertical shaft, said apparatus comprising a substantially flat circular disc, a cylindrical attachment collar connected to one side of said disc and extending therefrom coaxially therewith for coupling said disc to the shaft of the associated machine for rotation therewith, a plurality of groups of equiangularly spaced-apart holding members secured to the other side of said disc and extending therefrom, each of said groups of holding members including two parallel axle members extending therebetween, and a plurality of scarifying members rotatably mounted on each of said axle members for rotational scarifying engagement with the associated floor as said disc is rotated by the associated machine, said holding members and said axle members and said scarifying members being disposed entirely within the perimeter of said disc.

6. The apparatus of claim 5, wherein said disc includes four groups of holding members.

7. The apparatus of claim 5, wherein said axle means comprises means removably mounting said scarifying members on said holding members.

8. The apparatus of claim 5, wherein said axle means comprises a bolt extending through and between the holding members of a group and a fastening member engageable with said bolt for retaining it in place on said holding members.

9. The apparatus of claim 5, wherein each of said groups of holding members consists of two holding members.

* * * * *